US005297744A

United States Patent [19]

Clinton

[11] Patent Number: 5,297,744

[45] Date of Patent: Mar. 29, 1994

[54] MAGNETIC TUB GRINDER

[75] Inventor: L. Powell Clinton, Midland, Tex.

[73] Assignee: Fuel Harvesters Equipment, Inc., Midland, Tex.

[21] Appl. No.: 755,944

[22] Filed: Sep. 6, 1991

[51] Int. Cl.[5] ..... B02C 13/286

[52] U.S. Cl. ..... 241/81; 241/186.4; 209/8; 209/221

[58] Field of Search ..... 241/186.4, 81; 209/8, 209/221, 636

[56] References Cited

U.S. PATENT DOCUMENTS

| | | | |
|---|---|---|---|
| 3,510,072 | 5/1970 | Jacobson et al. | 241/73 |
| 4,106,706 | 8/1973 | Burrows | 241/186.2 |
| 4,350,307 | 9/1982 | Olson | 241/81 |
| 4,533,053 | 8/1985 | Kenny et al. | 209/221 X |
| 4,754,882 | 7/1988 | Petitpierre | 241/81 X |
| 4,773,601 | 9/1988 | Urich et al. | 241/101.7 |
| 4,896,836 | 1/1990 | Mitchell | 241/81 |

*Primary Examiner*—Eugenia Jones
*Attorney, Agent, or Firm*—Heller, Ehrman, White & McAuliffe

[57] ABSTRACT

A tub grinder for grinding waste material is disclosed. The tub grinder includes a cylindrical tub member having an open end for receiving waste material to be ground. The tub member includes a cylindrical interior wall having one or more magnets mounted thereon for extracting tramp iron from waste material in the tub member.

6 Claims, 5 Drawing Sheets

MAGNETIC TUB GRINDER

BACKGROUND OF THE INVENTION

The present invention relates in general to apparatus for grinding waste material. It relates in particular to a tub grinder.

Tub grinders are widely used for recovering useable wood material from waste wood products. A tub grinder includes a cylindrical receptacle, or tub, having an open end for receiving the waste wood. The diameter of the receptacle may be large enough that large waste items such as pallets and tree limbs may be placed in it. The tub is located above a generally flat floor and is mounted such that it may rotate relative to the floor about an axis of rotation perpendicular to the floor. Grinding apparatus for grinding the waste wood is located below the floor. The grinding apparatus extends partially through an aperture in the floor so that it may engage material in the tub.

The grinding apparatus may be a hammer-mill including a plurality of grinding elements mounted for rotation in a closed circular path around an axis perpendicular to the axis of rotation of the tub. A portion of the closed circular path extends through the aperture in the floor.

The tub grinder is operated by rotating the grinding elements and the tub. Material in the tub is moved, by the rotation of the tub, continuously across the aperture in the floor and into engagement with the grinding elements. Portions of the waste material are ground into particles by the elements. The particles fall through the aperture where they are further ground, i.e., milled, into smaller particles by the rotating elements. When the milled particles are sufficiently small they pass through one or more screens onto a conveyor which discharges them from the tub grinder.

Waste wood material may contain a number of different metal objects. These metal objects are generally referred to as tramp iron. Tramp iron may include small objects such as nuts, bolts, nails, and screws which may have been used in the construction of some items making up the wood waste. Tramp iron found in waste from yards, construction sites and demolition sites, however, may include relatively large objects, such as hand tools, garden tools, water pipe, electrical conduit, automobile parts, and kitchen appliances.

If tramp iron finds its way into the path of the rotating grinding elements, it may cause rapid wear of the grinding elements or may damage the grinding apparatus such that it will not function.

Apparatus for preventing tramp iron from reaching the grinding elements of a hammer-mill are described in U.S. Pat. Nos. 4,350,307 and 4,896,836. Each patent discloses the use of a magnetized surface for attracting and retaining tramp iron. The magnetized surface is located within a narrow enclosure above the hammer-mill. The narrow enclosure has an open end, or entrance aperture, for introducing waste material into the hammer-mill. In U.S. Patent No. 4,350,307, the magnetized surface is the surface of an inclined flat plate. In U.S. Patent No. 4,896,836, the magnetized surface is the outer surface of a rotating drum. The patents each disclose a stand-alone hammer-mill for grinding or milling wood or agricultural waste which is already in the form of small particles. The waste particles, which may include tramp iron, are gravity-fed into the hammer-mill, first passing over a magnetized surface before they fall into the path of the rotating elements of the hammer-mill. Tramp iron may thus be attracted to and retained by the magnetized surface before it can enter the path of the rotating elements.

In a tub grinder the grinding elements must be exposed directly to bulk waste so that they may break the bulk waste into particles which may subsequently fall into the grinding apparatus where they are further ground or milled. The magnetic extraction systems disclosed in the above references are designed to receive waste material already in particle form. As such, they could not be used to prevent tramp iron from reaching grinding elements of a hammer-mill which is a component of a tub grinder. Further, the magnetic surfaces partially restrict the entrance aperture of the hammer-mill and may result in the hammer-mill being blocked when large tramp iron objects are trapped by the magnetized surface.

Accordingly, it is an object of the present invention to provide apparatus for extracting tramp iron from waste material in a tub grinder.

It is another object of the present invention to provide apparatus for extracting relatively large objects, such as hand tools, garden tools, water pipe, electrical conduit, automobile parts and kitchen appliances, from waste material in a tub grinder.

It is yet another object of the present invention to provide apparatus for attracting and retaining tramp iron from a tub grinder which does not restrict the entrance aperture of a hammer-mill included in the tub grinder.

Additional objects of the invention will be set forth in the description which follows, and in part will be obvious from the description or may be learned by practice of the invention. The objects and advantages of the invention may be realized and obtained by means of the instrumentalities and combination particularly pointed out in the claims.

SUMMARY OF THE INVENTION

The present invention is directed to a tub grinder apparatus for grinding waste material. It includes an arrangement of magnets for extracting tramp iron from waste material placed in the apparatus for grinding.

The apparatus comprises a floor member having a rectangular aperture in its upper surface. A grinding apparatus for grinding the waste material is mounted below the floor member. The grinding apparatus may be a hammer-mill including a plurality of grinding elements mounted to rotate in a closed path extending through the aperture in the floor member.

A cylindrical tub member, having a cylindrical wall and an open end for receiving the waste material, includes at least one elongated protrusion for engaging the waste material. The protrusion extends along the wall and inwardly from the wall. The tub member extends above the floor member and the aperture and is mounted for rotation about an axis generally perpendicular to an upper surface of the floor member in a direction of rotation relative thereto.

At least one magnet is mounted on the wall above the floor member for attracting and retaining tramp metal included in the waste material.

The tub grinder apparatus includes means for rotating the tub member to move waste material placed therein, and means for rotating the grinding elements for grinding the material. Rotation of the tub member moves waste material into the path of the grinding elements to be ground. Tramp metal migrates toward the wall of the tub member, where it may be attracted to and retained by the magnet. The tramp iron may thus be prevented from entering the hammer-mill.

In a preferred embodiment of the present invention, the tub member includes six inward-extending protrusions, and six magnets. One magnet is mounted on the wall of the tub member adjacent to each protrusion, such that, in the usual direction of rotation of the tub member, the magnets are protected from direct impact with waste material in the tub member. The protrusions extend inward beyond the magnets for preventing tramp iron already retained on the magnets from being dislodged by impact with waste material.

The protrusions may include a sloping face. The sloping face causes the tub member and material therein to rotate at different rates, whereby the magnets circulate around waste material in the tub member as the material is moved.

DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

DETAILED DESCRIPTION OF THE INVENTION

Figure 1:
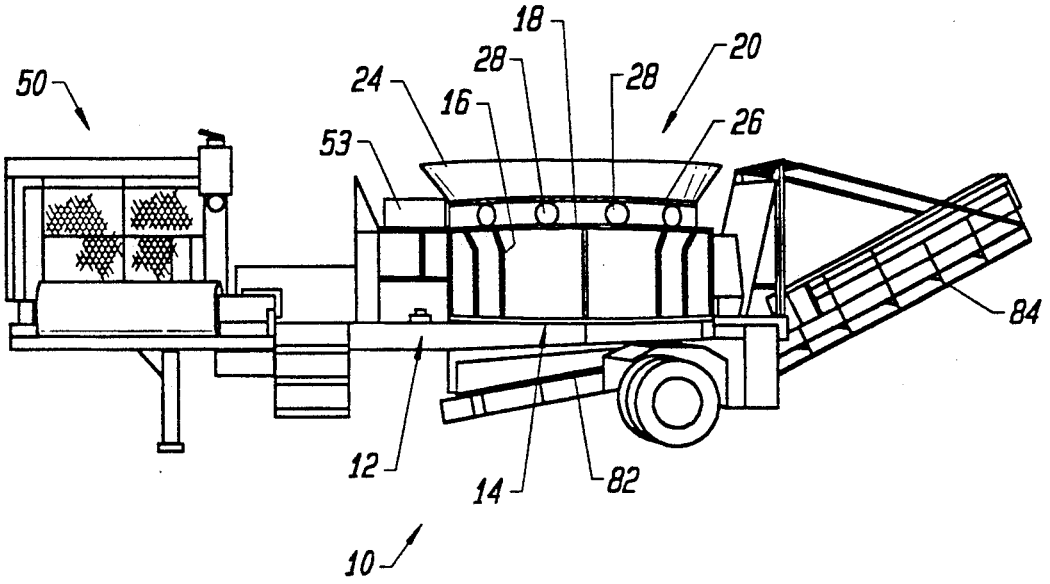
FIG. 1 schematically illustrates a pictorial view of a tub grinder apparatus in accordance with the present invention.
Figure 2:
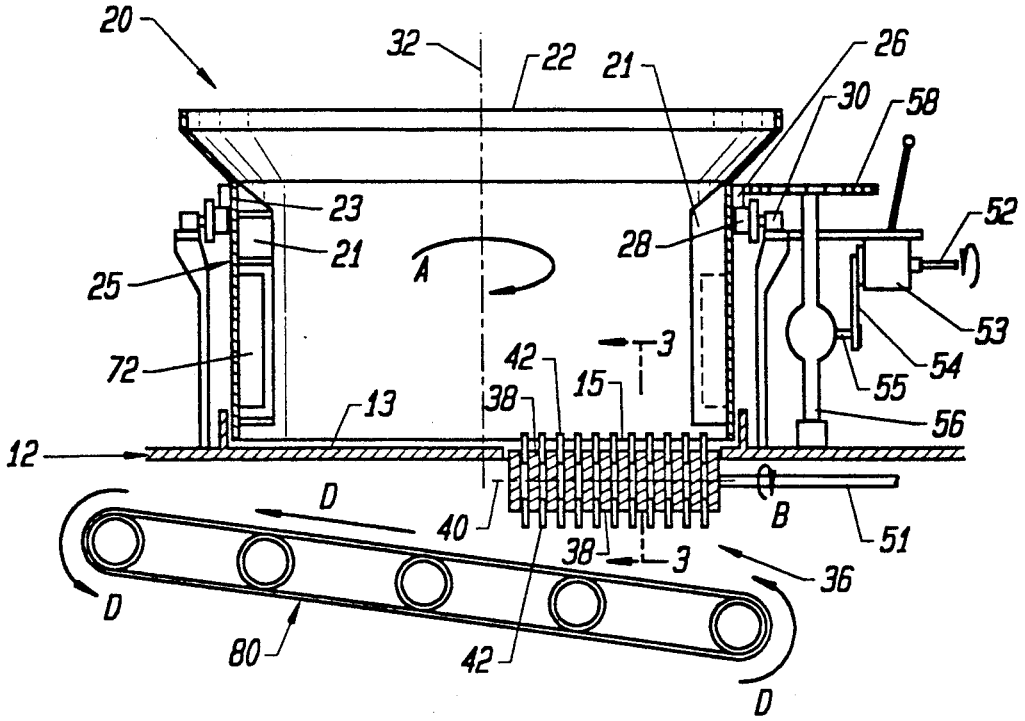
FIG. 2 schematically illustrates a cross-sectional view of a tub grinder apparatus of the present invention.
Figure 3:
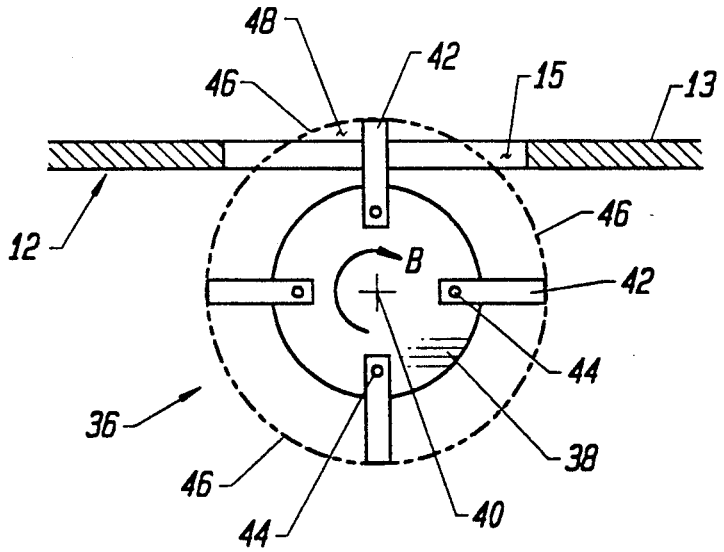
FIG. 3 is an enlarged cross sectional view along line 3—3 of FIG. 2 illustrating details of a hammer-mill.

Referring now to the drawings wherein like components are given like reference numerals, FIG. 1 shows an overall view of the tub grinder which is generally designated by the numeral 10. FIGS. 2 and 3 show details of the tub mounting, tub drive and grinding apparatus. The grinder 10 includes a floor member 12. Mounted on floor member 12 is a frame 14 including upright members 16 and a circular rim 18. A cylindrical tub member 20 extends above floor member 12 and includes an open end 22 for receiving waste material to be ground. Open end 22 is surrounded by an outward flared rim 24 for facilitating loading of waste material. Tub member 20 may include a steel cylinder 25 having a diameter of about ten feet and a depth of about five feet. Flared rim 24 extends outward about one foot from cylinder 25. Tub member 20 also includes elongated protrusions or paddles 21 for engaging waste material. Paddles 21 are mounted on cylindrical interior wall 23 and extend from wall 23 generally toward a central axis 32 of tub member 20. Tub member 20 generally should include at least one paddle 21 and preferably includes six paddles equally spaced around interior wall 23.

A toothed drive-ring 26 encircles tub member 20 below rim 24. Tub member 20 is suspended from drive ring 26 on rollers 28. Rollers 28 are mounted in bearings 30 on rim 18 of frame 14. As such, tub member 20 is mounted for rotation about central axis 32 which is generally perpendicular to upper surface 13 of floor member 12. Tub member 20 may be rotated for example in at least one direction of rotation, indicated by arrow A (See FIG. 4), relative to floor member 12 and upper surface 13. The direction indicated by arrow A may be referred to as the forward direction of rotation. Tub member 20 may also be rotated in a reverse direction, i.e., in the direction opposite to arrow A.

A grinding apparatus 36 is mounted below floor member 12. The grinding apparatus 36 may be a hammer-mill including a plurality of discs or shear plates 38 (See FIG. 3) mounted to rotate about an axis of rotation 40 generally perpendicular to axis of rotation 32. The grinding apparatus includes a plurality of grinding elements 42 pivotally mounted on shear plates 38 by pins 44. When shear plates 38 are rotated in the direction of rotation of arrow B, grinding elements 42 will rotate in a closed circular path 46. Usually grinding elements 42 are rotated against the forward direction of rotation of tub member 20.

Floor member 12 includes an aperture 15 extending through first surface 13. Grinding apparatus 36 is mounted below floor member 13 such that a portion thereof extends through aperture 15, and a portion of closed path 46 of extends through aperture 15 above upper surface 13 of floor member 12.

Referring again to FIG. 1, an engine 50 is provided for rotating tub member 20 and grinding apparatus 36. Engine 50 may be a CAT 3408 diesel engine developing about 500 horsepower. Power is transmitted from engine 50 to a main drive shaft 51 (See FIG. 2) for driving grinding apparatus 36. Power is also transmitted from engine 50 to a tub-drive shaft 52 through a variable-speed gear-box 53, drive belt 54 and shaft 55 to a differential 56. Differential 56 drives a sprocket 58 which engages toothed ring 26 for rotating tub member 20. Preferably, shaft 51 is driven at about 2000 revolutions per minute (rpm). Gear ratios of variable-speed gearbox 53 may be chosen such that tub member 20 may rotate at between about 3 and 12 rpm.

When tub member 20 is rotated, waste material placed therein is engaged by paddles 21 and moved across aperture 15 of floor member 13. Waste material is thus moved into upper portion 48 of path 46 of grinding elements 42. Grinding elements 42 are rotated such that the portion of the waste material in the path is ground or chipped into particles. The particles may then be forced by grinding elements 42, or may fall freely through aperture 15 into grinding apparatus 36. Here, they are further milled and forced through screens (not shown), which determine their final size. The milled particles fall onto a conveyor 80 moving in the direction indicated by the arrows D. Conveyor 80, which is located in housing 82 (See FIG. 1), carries the finally milled particles to a discharge chute 84. Illustrations of waste material and particles ground therefrom have been omitted from the drawings for clarity.

As already discussed, the waste material may include bulky items such as tree limbs, wooden boxes, crates, or pallets. The waste material may include tramp iron. As discussed above, it is preferable to keep as much as possible of this tramp iron from entering the path of grinding elements 42, and from falling into grinding apparatus 36.

Figure 4:
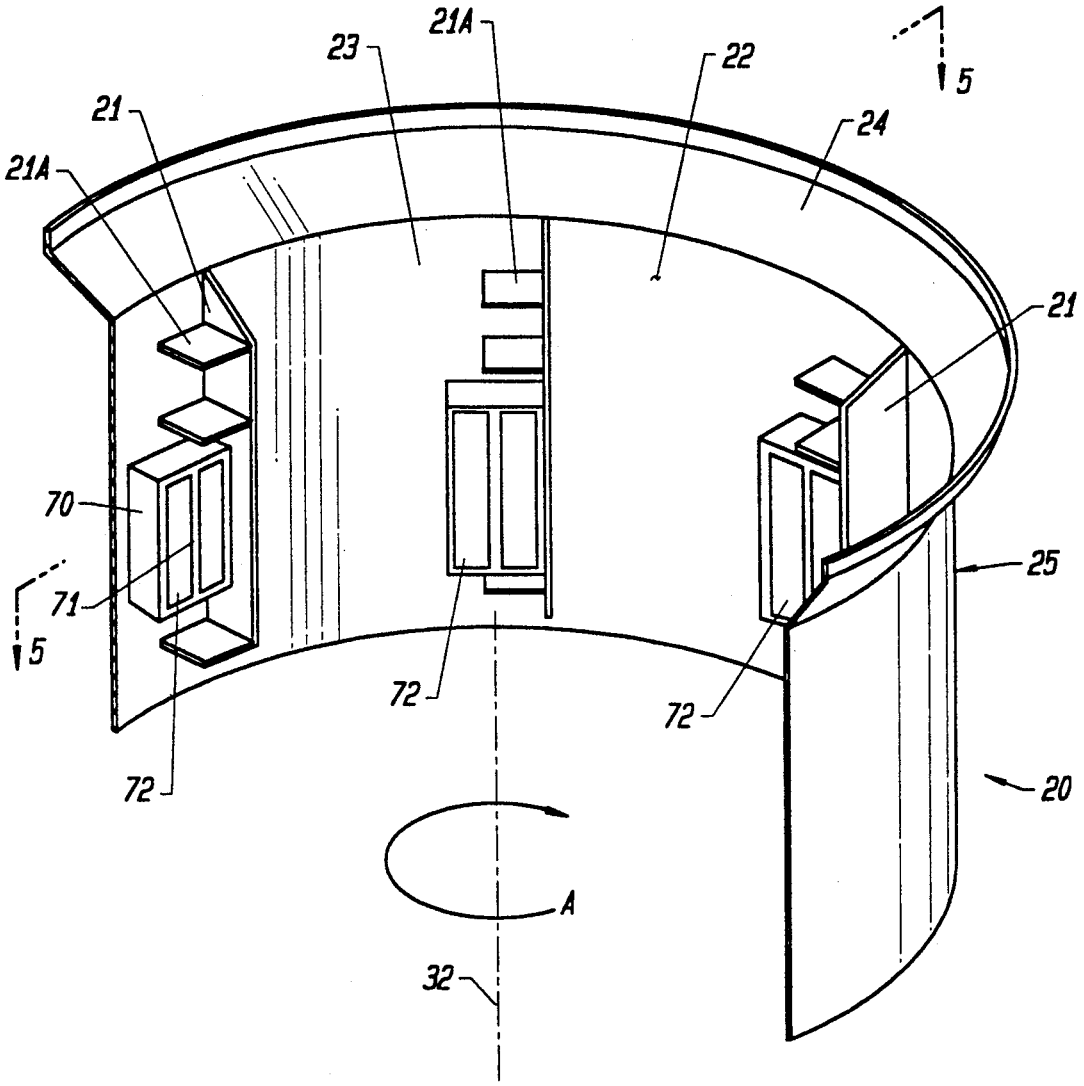
FIG. 4 schematically illustrates details of the tub member of the apparatus of FIGS. 1 and 2 showing the arrangement of magnets therein.
Figure 5:
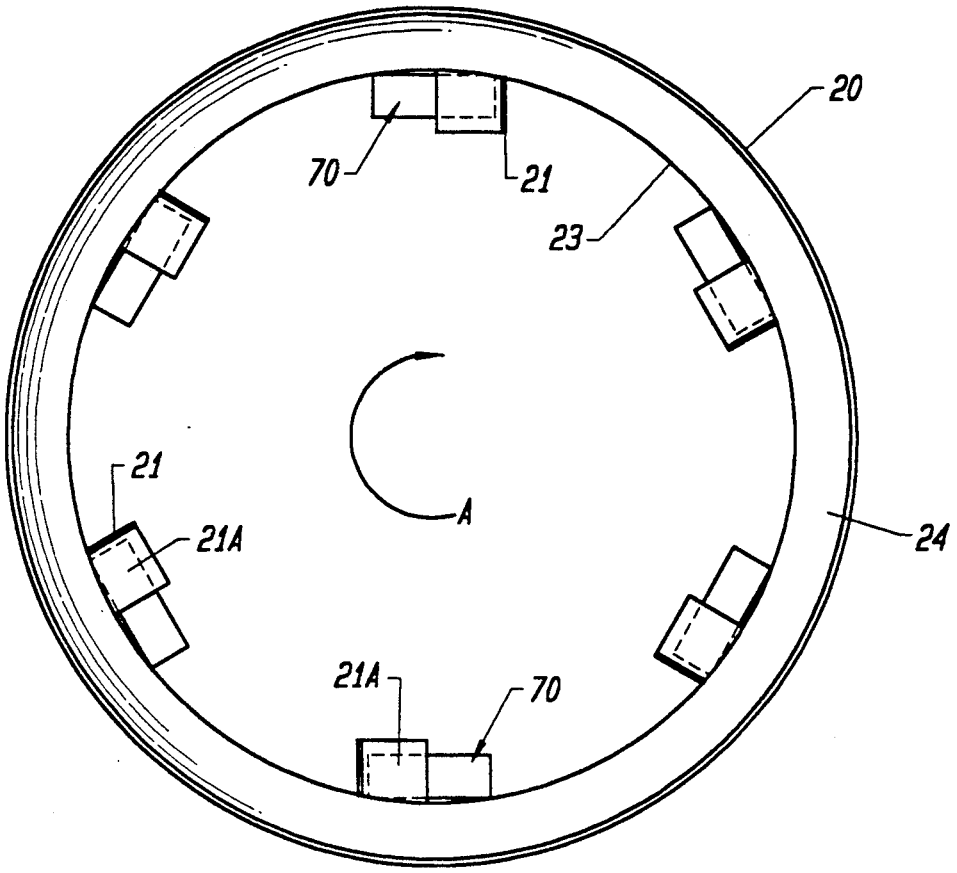
FIG. 5 is a plan view along lines 5—5 of FIG. 4.

Referring now to FIGS. 4 and 5, elongated magnets 72 are shown mounted on and extending along interior wall 23 and adjacent to paddles (protrusions) 21. At least one such magnet should be included in tub member 20 for attracting and retaining tramp iron from waste material placed therein, and six magnets are included. A magnet 72 may be mounted in a frame 70 including a strap 71 for attaching it to the wall. Preferably a magnet 72 is associated with each paddle 21 in tub member 20. Magnets 72 are preferably bar magnets having a length of about eighteen inches, a width of about 8 inches, and a thickness of about 3 inches.

During operation of tub grinder 10, it is important that magnets 72 be able to accumulate sufficient tramp iron so that operation may proceed for relatively long periods before it must be stopped to remove the accumulated tramp iron. It is thus important to prevent tramp from being removed from a magnet, by impact with waste material, as the tub member is rotated. Further, it is important to prevent repeated direct impacts on a magnet, as these may cause it to at least partially demagnetize and thus become ineffective for extracting tramp iron. These problems may be addressed as set forth below.

Magnets 72 are preferably mounted adjacent to paddles 21 on a side thereof opposite the forward direction of rotation. As such, paddles 21 precede magnets 70 when tub member 20 is rotated in its forward direction, indicated by arrow A in FIG. 5. Further, it is preferable that paddles 21 extend from interior wall 23 beyond magnets 72. Preferably paddles 21 extend about three inches beyond magnets 72. Paddles 21 may be provided with reinforcing members 21*a* to protect them from impact damage.

As tub member 20 is rotated, material therein is forced outward towards interior wall 23. It has been found that heavier metal objects have a greater tendency to move outward than the waste material in which they are contained. They may thus be attracted to and retained by the magnets before entering the grinding apparatus. Further, a charge of bulk waste material placed in tub member 20 must first be reduced to particles by grinding elements 42 extending above upper surface 13 so that the particles may fall through aperture 15 into grinding apparatus 36. The reduction to particles usually occurs gradually. For example, in apparatus of the present invention, a period of about fifteen minutes may be required to reduce a charge of bulk material weighing about 6,000 pounds. Waste material to be ground may thus be exposed to the magnets for an extended time period, resulting in efficient extraction of tramp iron.

When six magnet assemblies 72 are included in tub member 20, the total area of magnetized surface in tub member 20 may be about six square feet. As such, tub grinder 10 may be operated continuously for about 4 hours before it is necessary to stop the grinder to remove accumulated tramp iron from the magnets.

Figure 6:
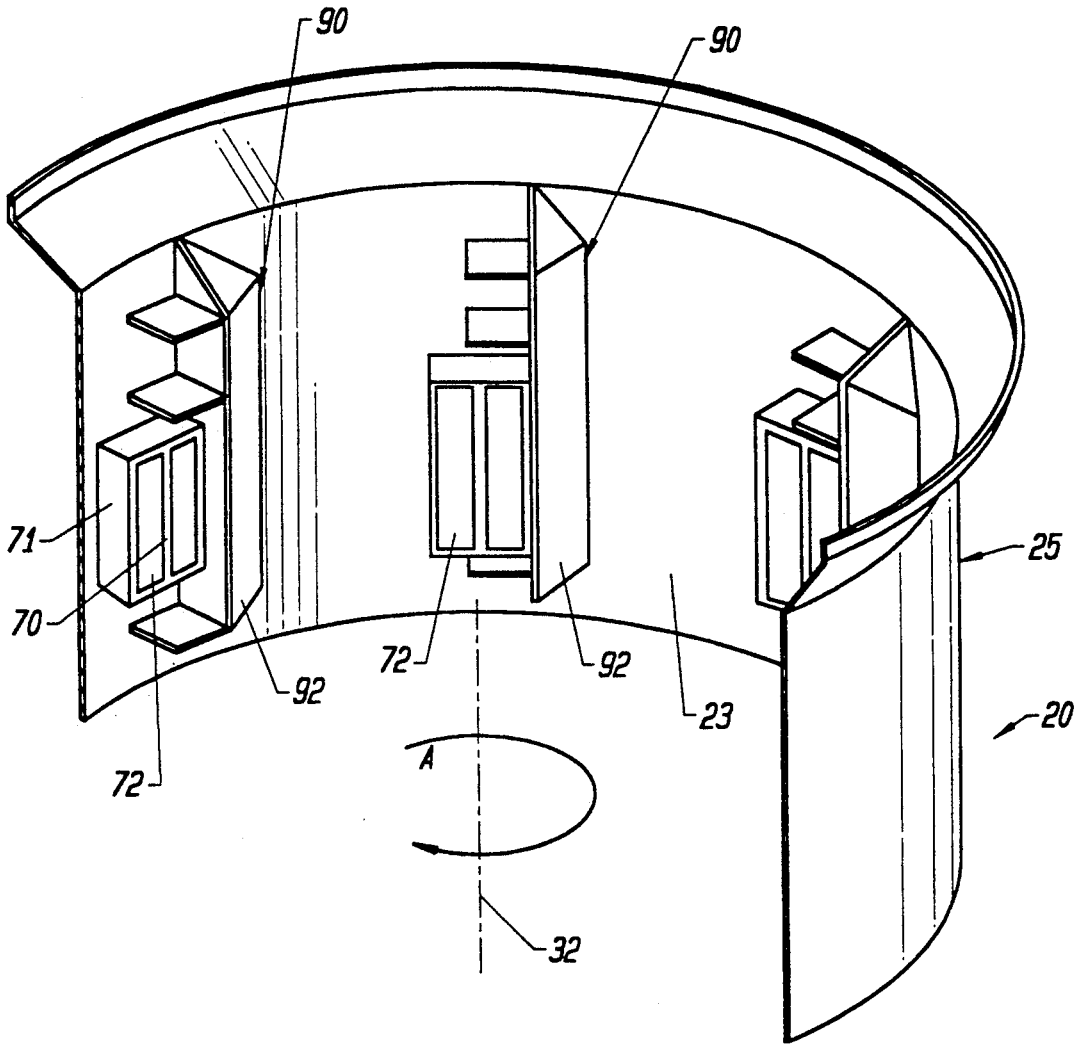
FIG. 6 schematically illustrates a tub member including elongated protrusions having a sloping surface.

In another embodiment of the present invention, elongated protrusions are designed so that they may cause a load of waste material in the tub member to be moved, i.e., rotated, at a lower angular velocity than the tub. As such, magnets 72 may be continuously circulated around the load of waste material while it is moving. The probability of tramp iron removal may thus be increased. Referring now to FIG. 6, tub member 20 includes inward-extending elongated protrusions 90 each having a sloping surface 92 inclined toward wall 23 and toward the forward direction of rotation of tub member 20, i.e., away from magnet 72. Sloping surface 92 causes protrusion 90 to engage slidably with waste material as tub member 20 is rotated. As such, while waste material may be moved or rotated by tub member 20, tub member 20 may rotate more quickly, causing relative movement between tub member 20 and waste material therein. The relative rotation will in effect cause magnets 72 to be circulated about a load of waste material in tub member 20.

The present invention has been described in terms of a preferred and other embodiments. The invention however is not limited to the embodiment described and depicted. Rather, the scope of the invention is defined by the appended claims.

What is claimed is:

1. An apparatus for grinding waste material, comprising:

a floor member having an upper surface including an aperture therethrough;

means mounted below said floor member for grinding the waste material, said grinding means including a plurality of grinding elements mounted to rotate in a closed path extending through said aperture;

a generally cylindrical tub member including an interior wall and having an open end for receiving the waste material, said tub member having a central axis generally perpendicular to said floor member, and at least one elongated protrusion extending from said wall toward said central axis for engaging the waste material;

said tub member extending above said floor member and mounted for rotation about said axis in at least one direction of rotation relative to said floor member;

at least one magnet mounted on said wall above said floor member for attracting and retaining tramp iron included in said waste material, said magnet mounted in close proximity to said elongated protrusion on one side thereof, so that said magnet immediately follows said elongated protrusion during said rotation; and rotating means for rotation of said tub member in said one direction of rotation so said elongated protrusion precedes said magnet during said rotation, whereby when said tub member is rotated, said magnet and tramp iron retained thereon is protected by said protrusion from impact with waste material.

2. The apparatus of claim 1 wherein said elongated protrusion extends from said wall beyond said magnet.

3. The apparatus of claim 2 wherein said protrusion includes a sloping surface.

4. The apparatus of claim 1 including six elongated protrusions and six magnets.

5. An apparatus for grinding waste material, comprising:

a floor member having an upper surface including an aperture therethrough;

means mounted below said floor member for grinding the waste material, said grinding means including a plurality of grinding elements mounted to rotate in a closed path extending through said aperture;

a cylindrical tub member including a wall and having an open end for receiving waste material, said tub member having an axis perpendicular to said upper surface of said floor member, and six elongated protrusions generally equally spaced around the wall and extending therefrom toward said axis for engaging the waste material;

said tub member extending above said floor member and mounted for rotation about said axis in at least one direction of rotation relative to said floor member;

means for rotating said tub member to move the waste material, whereby waste material may be moved into the path of said grinding elements; and six magnets mounted on said wall for attracting and retaining tramp iron included in the waste material, said magnets rotating with said tub member during rotation thereof and said magnets arranged such that one magnet is located in close proximity to each of said elongated protrusions on a side thereof, so said magnets immediately follow said elongated protrusions during said rotation, and so said elongated protrusions precede said magnets when said tub is rotated in said one direction of rotation to prevent damage to said magnets.

6. The apparatus of claim 5 wherein said protrusions have an inclined surface.

* * * * *